US009866986B2

(12) United States Patent
Milne et al.

(10) Patent No.: US 9,866,986 B2
(45) Date of Patent: Jan. 9, 2018

(54) AUDIO SPEAKER SYSTEM WITH VIRTUAL MUSIC PERFORMANCE

(71) Applicant: SONY CORPORATION, Tokyo (JP)

(72) Inventors: James R. Milne, Ramona, CA (US); Gregory Peter Carlsson, Santee, CA (US); Steven Martin Richman, San Diego, CA (US); Frederick J. Zustak, Poway, CA (US)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 14/163,415

(22) Filed: Jan. 24, 2014

(65) Prior Publication Data

US 2015/0215722 A1 Jul. 30, 2015

(51) Int. Cl.

| | |
|---|---|
| ***H04R 5/02*** | (2006.01) |
| ***H04S 7/00*** | (2006.01) |
| *H04R 5/00* | (2006.01) |

(52) U.S. Cl.

CPC ..... *H04S 7/305* (2013.01); *H04S 7/301* (2013.01)

(58) Field of Classification Search

CPC ..... H04R 27/00; H04R 2227/003; H04R 2227/005; H04R 3/00; H04R 5/00; H04S 7/00; H04S 1/007; H04S 2400/15; H04S 3/00

USPC ..... 381/119, 77, 80, 17, 26, 300; 700/94

See application file for complete search history.

(56) References Cited

U.S. PATENT DOCUMENTS

| | | | | |
|---|---|---|---|---|
| 4,332,979 | A | 6/1982 | Fischer | |
| 6,008,777 | A | 12/1999 | Yiu | |
| 6,091,826 | A | 7/2000 | Laitinen et al. | |
| 6,128,318 | A | 10/2000 | Sato | |
| 6,239,348 | B1 | 5/2001 | Metcalf | |
| 6,329,908 | B1 | 12/2001 | Frecska | |
| 6,611,678 | B1 | 8/2003 | Zweig et al. | |
| 6,741,708 | B1 * | 5/2004 | Nakatsugawa | H04R 5/04 381/77 |
| 7,007,106 | B1 | 2/2006 | Flood et al. | |
| 7,085,387 | B1 * | 8/2006 | Metcalf | H04R 5/00 369/5 |
| 7,146,011 | B2 | 12/2006 | Yang et al. | |
| 7,191,023 | B2 * | 3/2007 | Williams | G10H 1/0058 700/94 |
| 7,483,538 | B2 | 1/2009 | McCarty et al. | |

(Continued)

FOREIGN PATENT DOCUMENTS

| | | | |
|---|---|---|---|
| EP | 2346028 | A1 | 7/2011 |
| JP | 2005080227 | A | 3/2005 |

(Continued)

OTHER PUBLICATIONS

"Method and System for Discovery and Configuration of Wi-Fi Speakers", http://ip.com/IPCOM/000220175; Dec. 31, 2008.

(Continued)

*Primary Examiner* — Fan Tsang

*Assistant Examiner* — Norman Yu

(74) *Attorney, Agent, or Firm* — John L. Rogitz

(57) ABSTRACT

In a multi-speaker audio system for, e.g., a home entertainment system or other entertainment system, each networked-speaker (wired or wireless) can be assigned a particular voice, instrument, group of voices and/or instruments, or a particular stage location of a performance to reproduce a more realistic and life-like audio experience.

12 Claims, 5 Drawing Sheets

(56) References Cited

U.S. PATENT DOCUMENTS 7,483,958 B1 1/2009 Elabbady et al.
7,492,913 B2 2/2009 Connor et al.
7,689,613 B2 3/2010 Candelore
7,760,891 B2 7/2010 Biegelsen
7,792,311 B1 9/2010 Holmgren et al.
7,801,315 B2 9/2010 Watanabe et al.
7,822,835 B2 10/2010 Atkinson et al.
7,853,022 B2 12/2010 Thompson et al.
8,068,095 B2 11/2011 Pryor
8,077,873 B2 12/2011 Shridhar et al.
8,079,055 B2 12/2011 Hardacker et al.
8,179,755 B2 5/2012 Harris
8,199,941 B2 6/2012 Hudson et al.
8,296,808 B2 10/2012 Hardacker et al.
8,320,674 B2 11/2012 Guillou et al.
8,345,883 B2 1/2013 Takumai et al.
8,436,758 B2 5/2013 McLaughlin et al.
8,437,432 B2 5/2013 McLaughlin et al.
8,438,589 B2 5/2013 Candelore
8,509,463 B2 8/2013 Goh et al.
8,553,898 B2 10/2013 Raftery
8,605,921 B2 12/2013 Hesdahl
8,614,668 B2 12/2013 Pryor
8,621,498 B2 12/2013 Candelore
8,629,942 B2 1/2014 Candelore
8,677,224 B2 3/2014 McLaughlin et al.
8,760,334 B2 6/2014 McLaughlin et al.
8,811,630 B2 8/2014 Burlingame
9,054,790 B2 6/2015 McLaughlin et al.
9,161,111 B2 10/2015 Yuan et al.
9,282,196 B1 3/2016 Norris et al.
9,300,419 B2 3/2016 Knowles
9,485,556 B1 11/2016 List
9,693,168 B1 6/2017 Carlsson et al.
9,693,169 B1 6/2017 Carlsson et al.
2001/0037499 A1 11/2001 Turock et al.
2001/0055397 A1 12/2001 Norris et al.
2002/0054206 A1 5/2002 Allen
2002/0122137 A1 9/2002 Chen et al.
2002/0136414 A1 9/2002 Jordan et al.
2003/0046685 A1 3/2003 Srinivasan et al.
2003/0099212 A1 5/2003 Anjum et al.
2003/0107677 A1 6/2003 Lu et al.
2003/0210337 A1 11/2003 Hall
2004/0030425 A1* 2/2004 Yeakel ..... H04H 60/04 700/94
2004/0068752 A1 4/2004 Parker
2004/0196140 A1 10/2004 Sid
2004/0208324 A1 10/2004 Cheung et al.
2004/0264704 A1 12/2004 Huin et al.
2005/0024324 A1 2/2005 Tomasi et al.
2005/0125820 A1 6/2005 Nelson et al.
2005/0177256 A1* 8/2005 Shintani ..... H04R 27/00 700/94
2006/0106620 A1 5/2006 Thompson et al.
2006/0126878 A1 6/2006 Takumai et al.
2006/0195866 A1 8/2006 Thukral
2006/0227980 A1 10/2006 Barger
2006/0285697 A1 12/2006 Nishikawa et al.
2007/0183618 A1 8/2007 Ishii et al.
2007/0211022 A1 9/2007 Boillot
2007/0226530 A1 9/2007 Celinski et al.
2007/0233293 A1 10/2007 Villemoes et al.
2007/0297519 A1 12/2007 Thompson et al.
2008/0002836 A1 1/2008 Moeller et al.
2008/0025535 A1 1/2008 Rajapakse
2008/0031470 A1 2/2008 Angelhag
2008/0089268 A1 4/2008 Kinder et al.
2008/0141316 A1 6/2008 Igoe et al.
2008/0175397 A1 7/2008 Holman
2008/0207115 A1 8/2008 Lee et al.
2008/0253575 A1* 10/2008 Lorgeoux ..... H04L 12/66 381/2
2008/0259222 A1 10/2008 Hardacker et al.
2008/0279307 A1 11/2008 Gaffney et al.
2008/0279453 A1 11/2008 Candelore
2008/0304677 A1 12/2008 Abolfathi et al.
2008/0313670 A1 12/2008 Ho et al.
2009/0037951 A1 2/2009 Candelore et al.
2009/0041418 A1 2/2009 Candelore et al.
2009/0060204 A1 3/2009 Reams et al.
2009/0069081 A1 3/2009 Thorner
2009/0150569 A1 6/2009 Kumar et al.
2009/0172744 A1 7/2009 Rothschild
2009/0228285 A1 9/2009 Schnell et al.
2009/0252338 A1 10/2009 Koppens et al.
2009/0264114 A1 10/2009 Virolainen et al.
2009/0298420 A1 12/2009 Haartsen et al.
2009/0313675 A1 12/2009 Howarter et al.
2010/0220864 A1 9/2010 Martin
2010/0260348 A1 10/2010 Bhow et al.
2010/0272271 A1 10/2010 Hayakawa et al.
2010/0299639 A1* 11/2010 Ramsay ..... G06F 3/0486 715/835
2010/0316237 A1 12/2010 Elberbaum
2011/0091055 A1 4/2011 LeBlanc
2011/0103592 A1 5/2011 Kim et al.
2011/0157467 A1 6/2011 McRae
2011/0270428 A1 11/2011 Tam
2012/0011550 A1 1/2012 Holland
2012/0014524 A1 1/2012 Vafiadis
2012/0039477 A1 2/2012 Schijers et al.
2012/0058727 A1* 3/2012 Cook ..... H04W 4/06 455/41.3
2012/0069868 A1 3/2012 McLaughlin et al.
2012/0070004 A1 3/2012 LaBosco et al.
2012/0087503 A1 4/2012 Watson et al.
2012/0114151 A1 5/2012 Nguyen et al.
2012/0117502 A1 5/2012 Nguyen et al.
2012/0120218 A1 5/2012 Flaks et al.
2012/0120874 A1 5/2012 McLaughlin et al.
2012/0148075 A1* 6/2012 Goh ..... H04S 7/301 381/303
2012/0158972 A1 6/2012 Gammill et al.
2012/0174155 A1 7/2012 Mowrey et al.
2012/0177225 A1 7/2012 Springfield et al.
2012/0207307 A1 8/2012 Engdegard et al.
2012/0220224 A1 8/2012 Walker
2012/0254931 A1 10/2012 Oztaskent et al.
2012/0291072 A1 11/2012 Maddison et al.
2012/0314872 A1 12/2012 Tan et al.
2012/0320278 A1 12/2012 Yoshitani et al.
2013/0003822 A1 1/2013 Margulis
2013/0039514 A1 2/2013 Knowles et al.
2013/0042292 A1 2/2013 Buff et al.
2013/0051572 A1 2/2013 Goh et al.
2013/0052997 A1 2/2013 Killick et al.
2013/0055323 A1 2/2013 Venkitaraman et al.
2013/0077803 A1 3/2013 Konno et al.
2013/0109371 A1 5/2013 Brogan et al.
2013/0121515 A1 5/2013 Hooley et al.
2013/0156212 A1 6/2013 Bjelosevic et al.
2013/0191753 A1 7/2013 Sugiyama et al.
2013/0205319 A1 8/2013 Sinha et al.
2013/0210353 A1 8/2013 Ling et al.
2013/0223279 A1 8/2013 Tinnakornsrisuphap et al.
2013/0223660 A1 8/2013 Olafsson et al.
2013/0229577 A1 9/2013 McRae
2013/0237156 A1 9/2013 Jung et al.
2013/0238538 A1 9/2013 Cook et al.
2013/0249791 A1 9/2013 Pryor
2013/0272527 A1 10/2013 Oomen et al.
2013/0272535 A1 10/2013 Yuan et al.
2013/0279888 A1 10/2013 Zeng et al.
2013/0298179 A1 11/2013 Baum et al.
2013/0305152 A1 11/2013 Griffiths et al.
2013/0309971 A1 11/2013 Kiukkonen et al.
2013/0310064 A1 11/2013 Brachet et al.
2013/0312018 A1 11/2013 Elliott et al.
2013/0317905 A1 11/2013 Warner et al.
2013/0321268 A1 12/2013 Tuck et al.
2013/0325396 A1 12/2013 Yuen et al.
2013/0325954 A1 12/2013 Cupala et al.
2013/0326552 A1 12/2013 Adams

(56) References Cited

U.S. PATENT DOCUMENTS

| | | | | |
|---|---|---|---|---|
| 2013/0332957 | A1 | 12/2013 | DeWeese et al. | |
| 2014/0003623 | A1 | 1/2014 | Lang | |
| 2014/0003625 | A1 | 1/2014 | Sheen et al. | |
| 2014/0004934 | A1 | 1/2014 | Peterson et al. | |
| 2014/0009476 | A1 | 1/2014 | Venkitaraman et al. | |
| 2014/0011448 | A1 | 1/2014 | Yang | |
| 2014/0026193 | A1 | 1/2014 | Saxman et al. | |
| 2014/0064492 | A1 | 3/2014 | Lakkundi et al. | |
| 2014/0219483 | A1* | 8/2014 | Hong | H04R 5/02 381/307 |
| 2014/0254811 | A1 | 9/2014 | Takeda et al. | |
| 2014/0254829 | A1 | 9/2014 | Wang et al. | |
| 2014/0270306 | A1 | 9/2014 | Luna et al. | |
| 2014/0287806 | A1 | 9/2014 | Balachandreswaran | |
| 2014/0297296 | A1 | 10/2014 | Koppens et al. | |
| 2014/0323036 | A1 | 10/2014 | Daley et al. | |
| 2014/0328485 | A1 | 11/2014 | Saulters | |
| 2014/0355765 | A1 | 12/2014 | Kulavik et al. | |
| 2014/0362995 | A1 | 12/2014 | Backman et al. | |
| 2015/0078595 | A1 | 3/2015 | Shintani et al. | |
| 2015/0104026 | A1 | 4/2015 | Kappus et al. | |
| 2015/0128194 | A1 | 5/2015 | Kuang et al. | |
| 2015/0139439 | A1 | 5/2015 | Norris et al. | |
| 2015/0192241 | A1 | 7/2015 | Shannahan et al. | |
| 2015/0195649 | A1 | 7/2015 | Vogt | |
| 2015/0199122 | A1 | 7/2015 | Garmark et al. | |
| 2015/0201295 | A1 | 7/2015 | Lau et al. | |
| 2015/0208187 | A1 | 7/2015 | Carlsson et al. | |
| 2015/0208190 | A1 | 7/2015 | Hooks et al. | |
| 2015/0215722 | A1 | 7/2015 | Milne et al. | |
| 2015/0215723 | A1 | 7/2015 | Carlsson et al. | |
| 2015/0228262 | A1 | 8/2015 | Silfvast et al. | |
| 2015/0245157 | A1 | 8/2015 | Seefeldt | |
| 2015/0271620 | A1 | 9/2015 | Lando et al. | |
| 2015/0304789 | A1 | 10/2015 | Babayoff et al. | |
| 2015/0341737 | A1 | 11/2015 | Kallai et al. | |
| 2015/0350804 | A1 | 12/2015 | Crockett et al. | |
| 2015/0358707 | A1 | 12/2015 | Saijo et al. | |
| 2015/0358768 | A1 | 12/2015 | Luna et al. | |
| 2015/0373449 | A1 | 12/2015 | Jackson | |
| 2015/0382129 | A1 | 12/2015 | Florencio et al. | |
| 2016/0174012 | A1 | 6/2016 | Tan et al. | |
| 2016/0195856 | A1 | 7/2016 | Spero | |
| 2016/0286330 | A1 | 9/2016 | Kofman et al. | |
| 2016/0286350 | A1 | 9/2016 | Lin et al. | |
| 2016/0350067 | A1 | 12/2016 | Sundaresan et al. | |
| 2016/0359512 | A1 | 12/2016 | Fathollahi et al. | |
| 2017/0045941 | A1 | 2/2017 | Tokubo et al. | |
| 2017/0064457 | A1 | 3/2017 | Kupershmidt et al. | |
| 2017/0164099 | A1 | 6/2017 | Shintani et al. | |

FOREIGN PATENT DOCUMENTS

| | | | |
|---|---|---|---|
| JP | 2011004077 | * | 1/2011 |
| WO | 2009002292 | | 12/2008 |
| WO | 2012164444 | A1 | 12/2012 |
| WO | 2014184353 | A1 | 11/2014 |

OTHER PUBLICATIONS

Frieder Ganz, Payam Barnaghi, Francois Carrez, Klaus Moessner, "Context-Aware Management for Sensor Networks", University of Surrey, Guildford, UK publication, 2011.

Sokratis Kartakis, Margherita Antona, Constantine Stephandis, "Control Smart Homes Easily with Simple Touch", University of Crete, Crete, GR, 2011.

Gregory Peter Carlsson, Steven Martin Richman, James R. Milne, "Distributed Wireless Speakers System", file history of related pending U.S. Appl. No. 14/158,396, filed Jan. 17, 2014.

Gregory Peter Carlsson, Steven Martin Richman, James R. Milne, "Distributed Wireless Speaker System with Automatic Configuration Determination When New Speakers Are Added", file history of related pending U.S. Appl. No. 14/159,155, filed Jan. 20, 2014.

Gregory Peter Carlsson, Frederick J. Zustak, Steven Martin Richman, James R. Milne, "Wireless Speaker System with Distributed Low (Bass) Frequency", file history of related pending U.S. Appl. No. 14/163,213, filed Jan. 24, 2014.

Gregory Peter Carlsson, Frederick J. Zustak, Steven Martin Richman, James R. Milne, "Wireless Speaker System with Noise Cancelation", File History of related pending U.S. Appl. No. 14/163,089, filed Jan. 24, 2014.

Gregory Peter Carlsson, James R. Milne, Steven Martin Richman, Frederick J. Zustak, "Distributed Wireless Speaker System with Light Show", file history of related pending U.S. Appl. No. 14/163,542, filed Jan. 24, 2014.

Gregory Peter Carlsson, Keith Resch, Oscar Manuel Vega, "Networked Speaker System with Follow Me", file history of related allowed U.S. Appl. No. 14/199,137, filed Mar. 6, 2014.

Gregory Peter Carlsson, Keith Resch, Oscar Manuel Vega, "Networked Speaker System with Follow Me", related U.S. Appl. No. 14/974,413, Final Office Action dated Nov. 28, 2016.

James R. Milne, Gregory Carlsson, Steven Richman, Frederick Zustak, "Wireless Speaker System", related U.S. Appl. No. 15/044,981, Non-Final Office Action dated Nov. 28, 2016.

Peter Shintani, Gregory Carlsson, "Ultrasonic Speaker Assembly Using Variable Carrier Frequency to Establish Third Dimension Sound Locating", file history of related U.S. Appl. No. 14/158,396, filed Jul. 20, 2016.

Robert W. Reams, "N-Channel Rendering: Workable 3-D Audio for 4kTV", AES 135, New York City, 2013.

Gregory Peter Carlsson, Frederick J. Zustak, Steven Martin Richman, James R. Milne, "Wireless Speaker System with Distributed Low (Bass) Frequency", related U.S. Appl. No. 14/163,213, Final Office Action dated Feb. 23, 2016.

Gregory Peter Carlsson, James R. Milne, Steven Martin Richman, Frederick J. Zustak, "Distributed Wireless Speaker System with Light Show", related U.S. Appl. No. 14/163,542, Non-Final Office Action dated Feb. 24, 2016.

Gregory Peter Carlsson, Keith Resch, Oscar Manuel Vega, "Networked Speaker System with Follow Me", File history of related U.S. Appl. No. 14/974,413, filed Dec. 18, 2015.

James R. Milne, Gregory Carlsson, "Centralized Wireless Speaker System", file history of related U.S. Appl. No. 15/019,111, filed Feb. 9, 2016.

James R. Milne, Gregory Carlsson: "Distributed Wireless Speaker System", file history of related U.S. Appl. No. 15/044,920, filed Feb. 16, 2016.

James R. Milne, Gregory Carlsson, Steven Richman, Frederick Zustak, "Wireless Speaker System", filed history of related U.S. Appl. No. 15/044,981, filed Feb. 16, 2016.

"Ack Pro Mid-Sized Ball Bearing Brushless Gimbal With Turnigy 4008 Motors", Hobbyking.com, Retrieved on Nov. 27, 2015 from http://www.hobbyking/store/__51513__ACK__Pro__Mid__Sized__Ball__Bearing__Brushless__Gimbal__With__Turnigy__4008__Motors__NEX5__and__GF.html.

Patrick Lazik, Niranjini Rajagopal, Oliver Shih, Bruno Sinopoli, Anthony Rowe, "APLS: A Bluetooth and Ultrasound Platform for Mapping and Localization", Dec. 4, 2015, Carnegie Mellon University.

Santiago Elvira, Angel De Castro, Javier Garrido, "ALO4: Angle Localization and Orientation System with Four Receivers", Jun. 27, 2014, International Journal of Advanced Robotic Systems.

Woon-Seng Gan, Ee-Leng Tan, Sen M. Kuo, "Audio Projection: Directional Sound and Its Applications in Immersive Communication", 2011, IEE Signal Processing Magazine, 28(1), 43-57.

Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", file history of related U.S. Appl. No. 14/968,349, filed Dec. 14, 2015.

Gregory Carlsson, Masaomi Nishidate, Morio Usami, Kiyoto Shibuya, Norihiro Nagai, Peter Shintani, "Ultrasonic Speaker Assembly for Audio Spatial Effect", file history of related U.S. Appl. No. 15/018,128, filed Feb. 8, 2016.

Peter Shintani, Gregory Carlsson, "Gimbal-Mounted Linear Ultrasonic Speaker Assembly", file history of related U.S. Appl. No. 15/068,806, filed Mar. 14, 2016.

(56) References Cited

OTHER PUBLICATIONS

Gregory Carlsson, Morio Usami, Peter Shintani, "Ultrasonic Speaker Assembly with Ultrasonic Room Mapping", file history of related U.S. Appl. No. 15/072,098, filed Mar. 16, 2016.
Gregory Peter Carlsson, Steven Martin Richman, James R. Milne, "Distributed Wireless Speaker System", related U.S. Appl. No. 14/158,396, Final Office Action dated Jun. 20, 2016.
Gregory Peter Carlsson, Steven Martin Richman, James R. Milne, "Distributed Wireless Speaker System", related U.S. Appl. No. 14/158,396, Applicant's response to Final Office Action dated Jun. 20, 2016.
Gregory Peter Carlsson, James R. Milne, Steven Martin Richman, Frederick J. Zustak, "Distributed Wireless Speaker System with Light Show", related U.S. Appl. No. 14/163,542, Applicant's response to Non-Final Office Action dated Apr. 6, 2016.
Gregory Peter Calrsson, Frederick J. Zustak, Steven Martin Richman, James R. Milne, "Wireless Speaker System with Distributed Low (Bass) Frequency", related U.S. Appl. No. 14/163,213, Applicant's response to Final Office Action dated Mar. 15, 2016.
Gregory Peter Carlsson, Keith Resch, Oscar Manuel Vega, "Networked Speaker System with Follow Me", related U.S. Appl. No. 14/974,413, Non-Final Office Action dated Oct. 21, 2016.
Gregory Peter Carlsson, Keith Resch, Oscar Manuel Vega, "Networked Speaker System with Follow Me", related U.S. Appl. No. 14/974,413, Applicant's response to Non-Final Office Action dated Oct. 26, 2016.
Gregory Peter Carlsson, Steven Martin Richman, James R. Milne, "Distributed Wireless Speaker System", related pending U.S. Appl. No. 14/158,396 non-final office action dated Apr. 29, 2016.
Gregory Peter Carlsson, Steven Martin Richman, James R. Milne, "Distributed Wireless Speaker System", related pending U.S. Appl. No. 14/158,396 applicants response to non-final office action dated May 2, 2016.
Gregory Peter Carlsson, Keith Resch, Oscar Manuel Vega, "Networked Speaker System with Follow Me", related U.S. Appl. No. 14/974,413, Applicant's response to Non-Final Office Action dated Jan. 5, 2017.
Gregory Carlsson, Morio Usami, Peter Shintani, "Ultrasonic Speaker Assembly with Ultrasonic Room Mapping", related U.S. Appl. No. 15/072,098, Applicant's response to Non-Final Office Action dated Jan. 9, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No 15/018,128, Non-Final Office Action dated Jan. 17, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Applicant's response to Non-Final Office Action dated Jan. 18, 2017.
James R. Milne, Gregory Carlsson, "Distributed Wireless Speaker System", related U.S. Appl. No. 15/044,920, Non-Final Office Action dated Jan. 13, 2017.
James R. Milne, Gregory Carlsson, "Distributed Wireless Speaker System", related U.S. Appl. No. 15/044,920, Applicant's response to Non-Final Office Action dated Jan. 17, 2017.
James R. Milne, Gregory Carlsson, "Centralized Wireless Speaker System", related U.S. Appl. No. 15/019,111, Non-Final Office Action dated Jan. 20, 2017.
James R. Milne, Gregory Carlsson, "Centralized Wireless Speaker System", related U.S. Appl. No. 15/019,111, Applicant's response to Non-Final Office Action dated Jan. 25, 2017.
Gregory Peter Carlsson, Keith Resch, Oscar Manuel Vega, "Networked Speaker System With Follow Me", related U.S. Appl. No. 14/974,413, Final Office Action dated Feb. 21, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Final Office Action dated Feb. 27, 2017.
Gregory Carlsson, Masaomi Nishidate, Morio Usami, Kiyoto Shibuya, Norihiro Nagai, Peter Shintani, "Ultrasonic Speaker Assembly for Audio Spatial Effect", related U.S. Appl. No. 15/018,128, Applicant's response to Final Office Action dated Mar. 6, 2017.
James R. Milne, Gregory Carlsson, "Distributed Wireless Speaker System", related U.S. Appl. No. 15/044,920, Final Office Action dated Mar. 2, 2017.
James R. Milne, Gregory Carlsson, "Distributed Wireless Speaker System", related U.S. Appl. No. 15/044,920, Applicant's response to Final Office Action dated Mar. 14, 2017.
Gregory Peter Carlsson, Keith Resch, Oscar Manuel Vega, "Networked Speaker System with Follow Me", related U.S. Appl. No. 14/974,413, Applicant's response to Final Office Action dated Dec. 2, 2016.
Gregory Peter Carlsson, Keith Resch, Oscar Manuel Vega, "Networked Speaker System with Follow Me", related U.S. Appl. No. 14/974,413, Non-Final Office Action dated Dec. 21, 2016.
James R. Milne, Gregory Carlsson, Steven Richman, Frederick Zustak, "Wireless Speaker System", related U.S. Appl. No. 15/044,981, Applicant's response to Non-Final Office Action dated Dec. 14, 2016.
Gregory Carlsson, Morio Usami, Peter Shintani, "Ultrasonic Speaker Assembly With Ultrasonic Room Mapping", related U.S. Appl. No. 15/072,098, Non-Final Office Action dated Jan. 4, 2017.
James R. Milne, Gregory Carlsson, "Centralized Wireless Speaker System", related U.S. Appl. No. 15/019,111, Non-Final Office Action dated Apr. 21, 2017.
James R. Milne, Gregory Carlsson, "Centralized Wireless Speaker System", related U.S. Appl. No. 15/019,111, Applicant's response to Non-Final Office Action dated May 11, 2017.
James R. Milne, Gregory Carlsson, Steven Richman, Frederick Zustak, "Wireless Speaker System", Applicant's response to Final Office Action dated May 10, 2017.
Peter Shintani, Gregory Peter Carlsson, Morio Usami, Kiyoto Shibuya, Norihiro Nagai, "Gimbal-Mounted Ultrasonic Speaker for Audio Spatial Effect", related U.S. Appl. No. 14/968,349, Final Office Action dated May 23, 2017.
Peter Shintani, Gregory Peter Carlsson, Morio Usami, Kiyoto Shibuya, Norihiro Nagai, "Gimbal-Mounted Ultrasonic Speaker for Audio Spatial Effect", related U.S. Appl. No. 14/968,349, Applicant's response to Final Office Action dated Jun. 12, 2017.
Peter Shintani, Gregory Carlsson, "Gimbal-Mounted Linear Ultrasonic Speaker Assembly", related U.S. Appl. No. 15/068,806, Final Office Action dated May 25, 2017.
Peter Shintani, Gregory Carlsson, "Gimbal-Mounted Linear Ultrasonic Speaker Assembly", related U.S. Appl. No. 15/068,806, Applicant's response to Final Office Action dated Jun. 12, 2017.
James R. Milne, Gregory Carlsson, "Centralized Wireless Speaker System", related U.S. Appl. No. 15/019,111, Final Office Action dated Jun. 9, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Non-Final Office Action dated Mar. 20, 2017.
Peter Shintani, Gregory Peter Carlsson, Morio Usami, Kiyoto Shibuya, Norihiro Nagai, Masaomi Nishidate, "Gimbal-Mounted Ultrasonic Speaker for Audio Spatial Effect", related U.S. Appl. No. 14/968,349, Applicant's response to Non-Final Office Action filed Mar. 21, 2017.
Gregory Peter Carlsson, Keith Resch, Oscar Manuel Vega, "Networked Speaker System With Follow Me", related U.S. Appl. No. 14/974,413, Applicant's response to the Final Office Action dated Mar. 21, 2017.
James R. Milne, Gregory Carlsson, "Centralized Wireless Speaker System", related U.S. Appl. No. 15/019,111, Final Office Action dated Mar. 31, 2017.
James R. Milne, Gregory Carlsson, "Centralized Wireless Speaker System", related U.S. Appl. No. 15/019,111, Applicant's response to Final Office Action dated Apr. 4, 2017.
Peter Shintani, Gregory Carlsson, "Gimbal-Mounted Linear Ultrasonic Speaker Assembly", related U.S. Appl. No. 15/068,806, Non-Final Office Action dated Apr. 10, 2017.

(56) References Cited

OTHER PUBLICATIONS

Peter Shintani, Gregory Carlsson, "Gimbal-Mounted Linear Ultrasonic Speaker Assembly", related U.S. Appl. No. 15/068,806, Applicant's response to Non-Final Office Action dated Apr. 12, 2017.
James R. Milne, Gregory Carlsson, Steven Richman, Frederick Zustak, "Wireless Speaker System", related U.S. Appl. No. 15/044,981, Final Office Action dated Apr. 12, 2017.
Peter Shintani, Gregory Carlsson, "Gimbal-Mounted Linear Ultrasonic Speaker Assembly", related U.S. Appl. No. 15/068,806, Non-Final Office Action dated Jul. 13, 2017.
Peter Shintani, Gregory Carlsson, "Gimbal-Mounted Linear Ultrasonic Speaker Assembly", related U.S. Appl. No. 15/068,806, Applicant's response to Non-Final Office Action dated Jul. 17, 2017.
Peter Shintani, Gregory Carlsson, "Ultrasonic Speaker Assembly Using Variable Carrier Frequency to Establish Third Dimension Sound Locating", related U.S. Appl. No. 15/214,748, Non-Final Office Action dated Jul. 6, 2017.
Peter Shintani, Gregory Carlsson, "Ultrasonic Speaker Assembly Using Variable Carrier Frequency to Establish Third Dimension Sound Locating", related U.S. Appl. No. 15/214,748, Applicant's response to Non-Final Office Action dated Jul. 14, 2017.

* cited by examiner

AUDIO SPEAKER SYSTEM WITH VIRTUAL MUSIC PERFORMANCE

FIELD OF THE INVENTION

The present application relates generally to wireless speaker systems for creating virtual music performances.

BACKGROUND OF THE INVENTION

People who enjoy high quality sound, for example in home entertainment systems, prefer to use multiple speakers for providing stereo, surround sound, and other high fidelity sound. As understood herein, with the advent of metadata that may accompany audio tracks, identifying individual track characteristics, the entertainment experience can be augmented.

SUMMARY OF THE INVENTION

Present principles provide a networked speaker system that uses networked speakers to implement creation or recreation of a music performance by assigning specific tracks characterized by stage location, voice type, or instrument type to specific speakers, thus recreating a music ensemble on the "stage" established by the speakers.

Each networked amp/speaker can be assigned a single or multiple tracks of events so the number of tracks and the number of speakers can differ. This configuration can be static or dynamic. More specifically, each recorded track (analog or digital) is assigned a particular amplifier/speaker assembly, typically by user input. The number of channels typically is fixed and dictates the number of amps/speakers needed to faithfully reproduce the full recording. To facilitate track assignation, each networked-speaker has a unique identifier assigned to it, for example, a media access control (MAC) MAC address (Ethernet and/or Wi-Fi). The unique identification (UID) enables new possibilities for audio experiences (channel assignment, instrument assignment, etc.), as well as promoting high quality audio performance (i.e., detecting the digital stream—like 192 kHz or Sony DSD—and directly controlling to the amp/speaker accordingly).

Furthermore, a particular track, within a performance, can be allowed to be dynamic. For example, the track recording a lead singer can be given a dynamic assignment and can move from speaker to speaker to model the lead singer moving from center stage to stage right, then to stage left, and eventually back to center stage during a live performance. The dynamic track assignment can follow or mimic these movements.

The source material from which the audio is provided to the speakers can include metadata indicating the number and characteristics of individual tracks in the audio, e.g., voice tracks, specific instrument tracks, location tracks. This metadata can be provided with the audio data itself and/or made available in an application that can be downloaded to a computing device such as a mobile telephone if a user associated with the multi-speaker system. Other non-limiting example consumer electronic (CE) devices that may execute the application include a tablet computer, PC, TV, Blu-ray player, or audio video recorder (AVR). The metadata can be stored and recalled from an Internet server, as well. The end user of the multi-speaker system arranges the speakers in a particular physical configuration and inputs that information into the application executing on the CE device, which then enables the end user to assign each track of the audio recording to a particular speaker or to choose a default setting based on the arrangement and number of present networked-speakers. Particular track-to-speaker correlations for individual preferences, particular venues or concert performances, program genres, etc. can be saved and recalled for later use. The configurations can be stored and recalled from an Internet server and shared with others over the internet so that users can load configurations from other people via the Internet.

Accordingly, a device includes at least one computer readable storage medium bearing instructions executable by a processor, and at least one processor configured for accessing the computer readable storage medium to execute the instructions to configure the processor for receiving plural audio speaker identifications (IDs), with each ID being associated with a respective speaker. The processor when executing the instructions is configured for receiving information regarding plural tracks of an audio recording. The information indicates for each track one or more of: individual instruments, individual voice types, individual voice roles, individual instrument types, modeled stage position of a source of audio for the respective track. The processor when executing the instructions is configured for mapping tracks to respective speakers.

In some embodiments the processor when executing the instructions is configured for mapping tracks to respective speakers based at least in part on user input. The information regarding plural tracks of an audio recording may be received from a storage medium bearing the audio recording, and/or it may be received from a network server separate from a storage medium bearing the audio recording.

In another aspect, a method includes receiving first information pertaining to plural tracks of an audio recording, and receiving second information pertaining to plural speakers in an audio system. Based at least in part on user input and using the first and second information, the method maps tracks to respective speakers.

In another aspect, a system includes at least one computer readable storage medium bearing instructions executable by a processor which is configured for accessing the computer readable storage medium to execute the instructions to configure the processor for presenting on a consumer electronics (CE) device a user interface (UI). Based on input from the UI, the processor when accessing the instructions is configured for assigning each of plural networked audio speakers, from an audio recording, a respective voice, instrument, group of voices and/or instruments, or a particular stage location of a performance to reproduce a more realistic and life-like audio experience.

The details of the present application, both as to its structure and operation, can be best understood in reference to the accompanying drawings, in which like reference numerals refer to like parts, and in which:

DETAILED DESCRIPTION OF THE PREFERRED EMBODIMENT

Figure 1:
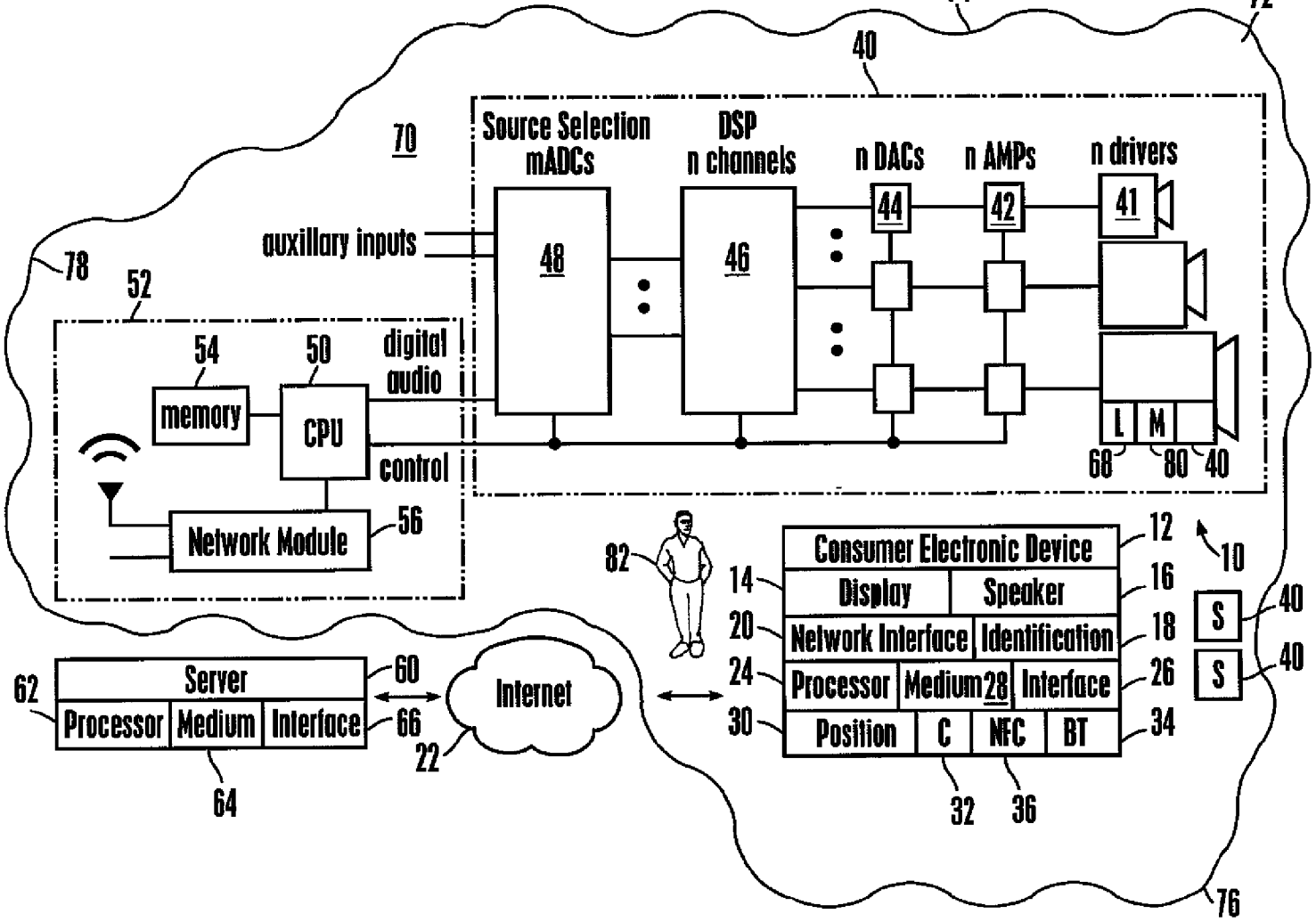
FIG. 1 is a block diagram of an example system including an example in accordance with present principles.

This disclosure relates generally to computer ecosystems including aspects of multiple audio speaker ecosystems. A system herein may include server and client components, connected over a network such that data may be exchanged between the client and server components. The client components may include one or more computing devices that have audio speakers including audio speaker assemblies per se but also including speaker-bearing devices such as portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers may include one or more processors executing instructions that configure the servers to receive and transmit data over a network such as the Internet. Or, a client and server can be connected over a local intranet or a virtual private network.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers. A processor may be implemented by a digital signal processor (DSP), for example.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on or transmitted through a computer-readable storage medium such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires. Such connections may include wireless communication connections including infrared and radio.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example system 10 is shown, which may include one or more of the example devices mentioned above and described further below in accordance with present principles. The first of the example devices included in the system 10 is an example consumer electronics (CE) device 12. The CE device 12 may be, e.g., a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, etc., and even e.g. a computerized Internet-enabled television (TV). Regardless, it is to be understood that the CE device 12 is configured to undertake present principles (e.g. communicate with other devices to undertake present principles, execute the logic described herein, and perform any other functions and/or operations described herein).

Accordingly, to undertake such principles the CE device 12 can be established by some or all of the components shown in FIG. 1. For example, the CE device 12 can include one or more touch-enabled displays 14, one or more speakers 16 for outputting audio in accordance with present principles, and at least one additional input device 18 such as e.g. an audio receiver/microphone for e.g. entering audible commands to the CE device 12 to control the CE device 12. The example CE device 12 may also include one or more network interfaces 20 for communication over at least one network 22 such as the Internet, an WAN, an LAN, etc. under control of one or more processors 24. It is to be understood that the processor 24 controls the CE device 12 to undertake present principles, including the other elements of the CE device 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, Wi-Fi transceiver, etc.

In addition to the foregoing, the CE device 12 may also include one or more input ports 26 such as, e.g., a USB port to physically connect (e.g. using a wired connection) to another CE device and/or a headphone port to connect headphones to the CE device 12 for presentation of audio from the CE device 12 to a user through the headphones. The CE device 12 may further include one or more tangible computer readable storage medium or memory 28 such as disk-based or solid state storage. Also in some embodiments, the CE device 12 can include a position or location receiver such as but not limited to a GPS receiver and/or altimeter 30 that is configured to e.g. receive geographic position information from at least one satellite and provide the information to the processor 24 and/or determine an altitude at which the CE device 12 is disposed in conjunction with the processor 24. However, it is to be understood that that another suitable position receiver other than a GPS receiver and/or altimeter may be used in accordance with present principles to e.g. determine the location of the CE device 12 in e.g. all three dimensions.

Continuing the description of the CE device 12, in some embodiments the CE device 12 may include one or more cameras 32 that may be, e.g., a thermal imaging camera, a digital camera such as a webcam, and/or a camera integrated into the CE device 12 and controllable by the processor 24 to gather pictures/images and/or video in accordance with present principles. Also included on the CE device 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the CE device 12 may include one or more motion sensors (e.g., an accelerometer, gyroscope, cyclometer, magnetic sensor, infrared (IR) motion sensors such as passive IR sensors, an optical sensor, a speed and/or cadence sensor, a gesture sensor (e.g. for sensing gesture command), etc.) providing input to the processor 24. The CE device 12 may include still other sensors such as e.g. one or more climate sensors (e.g. barometers, humidity sensors, wind sensors, light sensors, temperature sensors, etc.) and/or one or more biometric sensors providing input to the processor 24. In addition to the foregoing, it is noted that in some embodiments the CE device 12 may also include a kinetic energy harvester to e.g. charge a battery (not shown) powering the CE device 12.

In some examples the CE device 12 is used to control multiple ("n", wherein "n" is an integer greater than one) speakers 40 in respective speaker housings, each of can have multiple drivers 41, with each driver 41 receiving signals from a respective amplifier 42 over wired and/or wireless links to transduce the signal into sound (the details of only a single speaker shown in FIG. 1, it being understood that the other speakers 40 may be similarly constructed). Each amplifier 42 may receive over wired and/or wireless links an analog signal that has been converted from a digital signal by a respective standalone or integral (with the amplifier) digital to analog converter (DAC) 44. The DACs 44 may receive, over respective wired and/or wireless channels, digital signals from a digital signal processor (DSP) 46 or other processing circuit. The DSP 46 may receive source selection signals over wired and/or wireless links from plural analog to digital converters (ADC) 48, which may in turn receive appropriate auxiliary signals and, from a control processor 50 of a control device 52, digital audio signals over wired and/or wireless links. The control processor 50 may access a computer memory 54 such as any of those described above and may also access a network module 56 to permit wired and/or wireless communication with, e.g., the Internet. As shown in FIG. 1, the control processor 50 may also communicate with each of the ADCs 48, DSP 46, DACs 44, and amplifiers 42 over wired and/or wireless links. In any case, each speaker 40 can be separately addressed over a network from the other speakers.

More particularly, in some embodiments, each speaker 40 may be associated with a respective network address such as but not limited to a respective media access control (MAC) address. Thus, each speaker may be separately addressed over a network such as the Internet. Wired and/or wireless communication links may be established between the speakers 40/CPU 50, CE device 12, and server 60, with the CE device 12 and/or server 60 being thus able to address individual speakers, in some examples through the CPU 50 and/or through the DSP 46 and/or through individual processing units associated with each individual speaker 40, as may be mounted integrally in the same housing as each individual speaker 40.

The CE device 12 and/or control device 52 of each individual speaker train (speaker+amplifier+DAC+DSP, for instance) may communicate over wired and/or wireless links with the Internet 22 and through the Internet 22 with one or more network servers 60. Only a single server 60 is shown in FIG. 1. A server 60 may include at least one processor 62, at least one tangible computer readable storage medium 64 such as disk-based or solid state storage, and at least one network interface 66 that, under control of the processor 62, allows for communication with the other devices of FIG. 1 over the network 22, and indeed may facilitate communication between servers and client devices in accordance with present principles. Note that the network interface 66 may be, e.g., a wired or wireless modem or router, Wi-Fi transceiver, or other appropriate interface such as, e.g., a wireless telephony transceiver.

Accordingly, in some embodiments the server 60 may be an Internet server, may include and perform "cloud" functions such that the devices of the system 10 may access a "cloud" environment via the server 60 in example embodiments. In a specific example, the server 60 downloads a software application to the CE device 12 for control of the speakers 40 according to logic below. The CE device 12 in turn can receive certain information from the speakers 40, such as their GPS location, and/or the CE device 12 can receive input from the user, e.g., indicating the locations of the speakers 40 as further disclosed below. Based on these inputs at least in part, the CE device 12 may execute the speaker optimization logic discussed below, or it may upload the inputs to a cloud server 60 for processing of the optimization algorithms and return of optimization outputs to the CE device 12 for presentation thereof on the CE device 12, and/or the cloud server 60 may establish speaker configurations automatically by directly communicating with the speakers 40 via their respective addresses, in some cases through the CE device 12. Note that if desired, each speaker 40 may include a respective one or more lamps 68 that can be illuminated on the speaker.

Typically, the speakers 40 are disposed in an enclosure 70 such as a room, e.g., a living room. For purposes of disclosure, the enclosure 70 has (with respect to the example orientation of the speakers shown in FIG. 1) a front wall 72, left and right side walls 74, 76, and a rear wall 78. One or more listeners 82 may occupy the enclosure 70 to listen to audio from the speakers 40. One or more microphones 80 may be arranged in the enclosure for generating signals representative of sound in the enclosure 70, sending those signals via wired and/or wireless links to the CPU 50 and/or the CE device 12 and/or the server 60. In the non-limiting example shown, each speaker 40 supports a microphone 80, it being understood that the one or more microphones may be arranged elsewhere in the system if desired.

The location of the walls 72-78 may be input by the user using, e.g., a user interface (UI) in which the user may draw, as with a finger or stylus on a touch screen display 14 of a CE device 12, the walls 72-78 and locations of the speakers 40. Or, the position of the walls may be measured by emitting chirps, including a frequency sweep, in sequence from each of the speakers 40 as detected by each of the microphones 80 and/or from the microphone 18 of the CE device 12, determining, using the formula distance=speed of sound multiplied by time until an echo is received back, the distance between the emitting microphone and the walls returning the echoes. Note in this embodiment the location of each speaker (inferred to be the same location as the associated microphone) is known as described above. By computationally modeling each measured wall position with the known speaker locations, the contour of the enclosure 70 can be approximately mapped.

Figure 2:
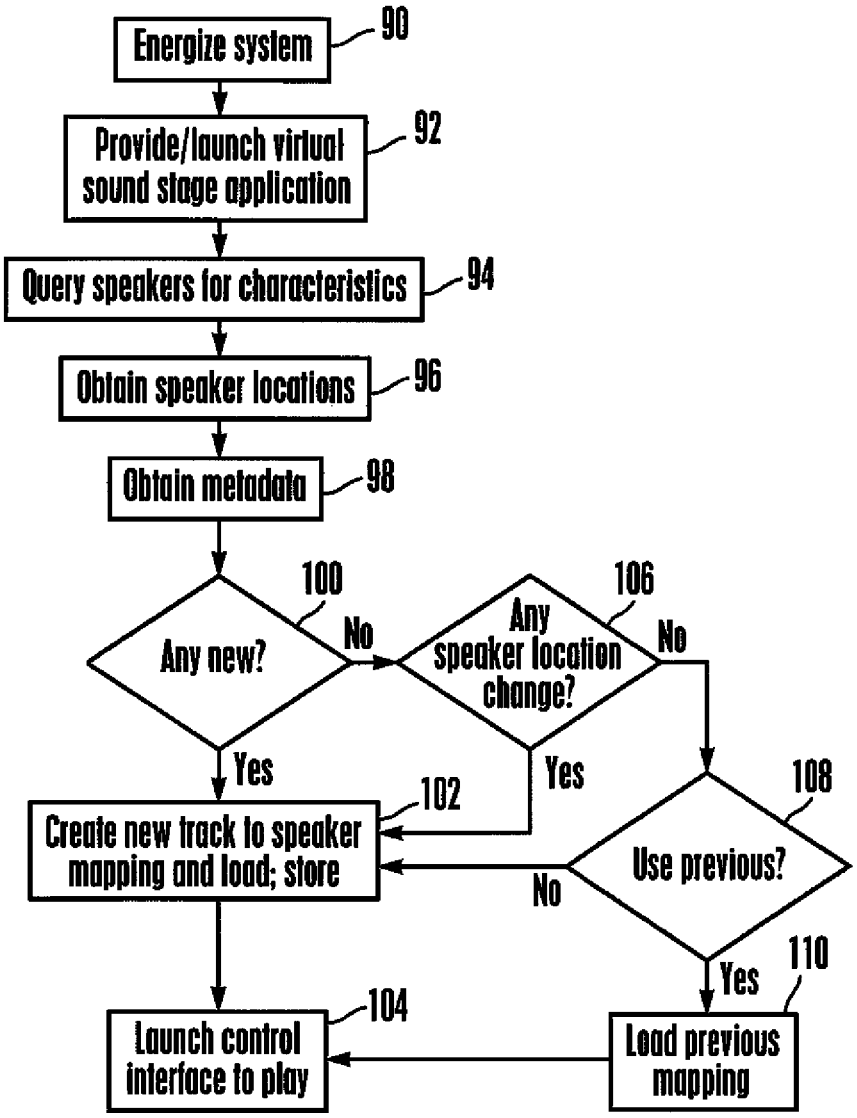
FIGS. 2 and 2A are flow charts of example logic according to present principles.

Now referring to FIG. 2, a flow chart of example logic is shown. The logic shown in FIG. 2 may be executed by one or more of the CPU 50, the CE device 12 processor 24, and the server 60 processor 62. The logic may be executed at application boot time when a user, e.g. by means of the CE device 12, launches a control application.

Commencing at block 90, the speaker system is energized, and at block 92 an application is provided and launched, e.g., on the CE device 12 or by the server 60 controlling the speaker system or a combination thereof, to provide a virtual sound stage management application. A Wi-Fi or network connection to the server 60 from the CE device 12 and/or CPU 50 may be provided to enable updates or acquisition of the application or applications herein. The application may be vended or otherwise included or recommended with audio products to aid the user in achieving the best system performance. An application (e.g., via Android, iOS, or URL) can be provided to the customer for use on the CE device 12. The user initiates the application, answers questions/prompts, and controls sound stage management as a result. Speaker parameters such as EQ and time alignment may be updated automatically via the network.

At block 94, if the speaker characteristics have not already been obtained, the executing computer (e.g., the CE device 12) queries the speakers for their capabilities/characteristics. Relevant characteristics include frequency range the speaker is capable of reproducing, for example. Querying may be done by addressing each speaker CPU 50 by the speaker's unique network address. As mentioned earlier, wired or wireless (e.g., Wi-Fi) communication links may be established between the CE device 2 and speakers 40.

At block 96, speaker location is obtained for each speaker identification (ID). To determine speaker location, position information may be received from each speaker 40 as sensed by a global positioning satellite (GPS) receiver on the speaker, or as determined using Wi-Fi (via the speaker's MAC address, Wi-Fi signal strength, triangulation, etc. using a Wi-Fi transmitter associated with each speaker location, which may be mounted on the respective speaker), ultra wideband (UWB) locating principles, etc. to determine speaker location. Or, the speaker location may be input by the user as discussed further below.

For each audio track sought to be played, its metadata is obtained at block 98. This may be done by accessing the storage medium on which the audio track is stored, with the metadata being stored along with the audio data. Or, a server can be contacted and the name of the audio file input to receive back metadata that is looked up by the server describing the tracks of the file. The metadata may correlate each of multiple tracks to respective instruments and/or voices and/or modeled relative locations, e.g., "right", "center", "left", rear", etc.

Proceeding to decision diamond 100, the logic may determine whether any new speakers have been added to the system since the previous time the application was run. This may be done by comparing the unique speaker IDs to a list of previous speaker IDs and if any new IDs are detected at decision diamond 100, the logic moves to block 102 to create a new audio track-to-speaker mapping as discussed further below. The new mapping is loaded and stored and then at block 104 a control interface may be launched, e.g., on the CE device 12, to begin play of a selected audio file, with the metadata for that file being accessed to identify the tracks in the file and the tracks then being mapped to respective speakers according to the mapping at block 102.

If no new speakers have been added, the logic may proceed to decision diamond 106 to determine whether any speaker locations have changed since the prior time the application was launched. This may be done by comparing the currently reported locations to the previously stored locations for each speaker ID. If any locations have changed, the logic may loop to block 102 to proceed as described. Otherwise, the logic may proceed to decision diamond 108 to determine whether a previous track-to-speaker mapping is to be used, e.g., based on use input as described further below, and if not the logic loops to block 102. Otherwise, the logic loads the previous mapping at block 110 and launches the control interface at block 104.

Figure 2A:
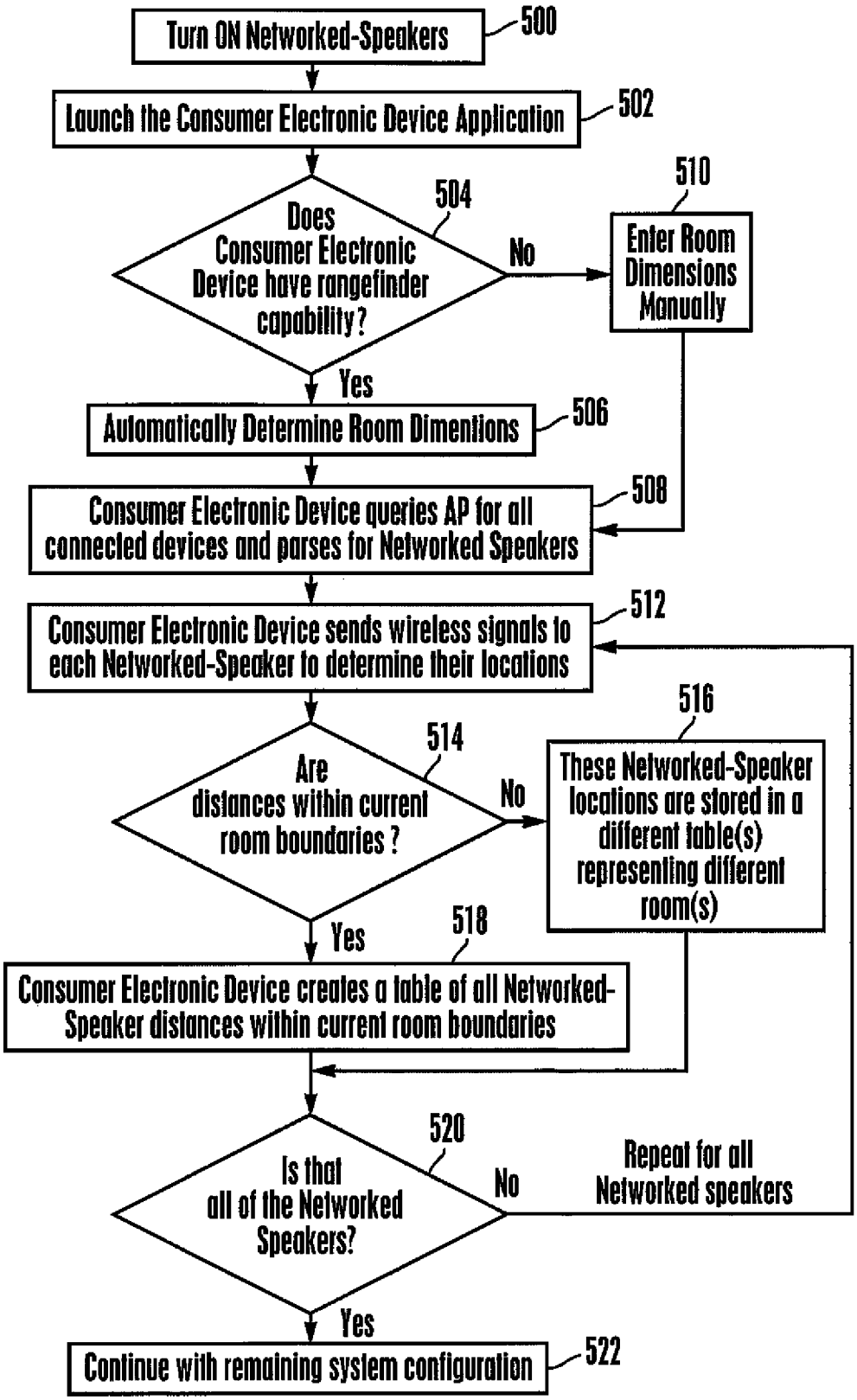

FIG. 2A illustrates supplemental logic in addition to or in lieu of some of the logic disclosed elsewhere herein that may be employed in example non-limiting embodiments to discover and map speaker location and room (enclosure 70) boundaries. Commencing at block 500, the speakers are energized and a discovery application for executing the example logic below is launched on the CE device 12. If the CE device 12 has range finding capability at decision diamond 504, the CE device (assuming it is located in the enclosure) automatically determines the dimensions of the enclosure in which the speakers are located relative to the current location of the CE device 12 as indicated by, e.g., the GPS receiver of the CE device. Thus, not only the contours but the physical locations of the walls of the enclosure are determined. This may be executed by, for example, sending measurement waves (sonic or radio/IR) from an appropriate transceiver on the CE device 12 and detecting returned reflections from the walls of the enclosure, determining the distances between transmitted and received waves to be one half the time between transmission and reception times the speed of the relevant wave. Or, it may be executed using other principles such as imaging the walls and then using image recognition principles to convert the images into an electronic map of the enclosure.

From block 506 the logic moves to block 508, wherein the CE device queries the speakers, e.g., through a local network access point (AP), by querying for all devices on the local network to report their presence and identities, parsing the respondents to retain for present purposes only networked audio speakers. On the other hand, if the CE device does not have rangefinding capability the logic moves to block 510 to prompt the user of the CE device to enter the room dimensions.

From either block 508 or block 510 the logic flows to block 512, wherein the CE device 12 sends, e.g., wirelessly via Bluetooth, Wi-Fi, or other wireless link a command for the speakers to report their locations. These locations may be obtained by each speaker, for example, from a local GPS receiver on the speaker, or a triangulation routine may be coordinated between the speakers and CE device 12 using ultra wide band (UWB) principles. UWB location techniques may be used, e.g., the techniques available from DecaWave of Ireland, to determine the locations of the speakers in the room. Some details of this technique are described in Decawave's USPP 20120120874, incorporated herein by reference. Essentially, UWB tags, in the present case mounted on the individual speaker housings, communicate via UWB with one or more UWB readers, in the present context, mounted on the CE device 12 or on network access points (APs) that in turn communicate with the CE device 12. Other techniques may be used.

The logic moves from block 512 to decision diamond 514, wherein it is determined, for each speaker, whether its location is within the enclosure boundaries determined at block 506. For speakers not located in the enclosure the logic moves to block 516 to store the identity and location of that speaker in a data structure that is separate from the data structure used at block 518 to record the identities and IDs of the speakers determined at decision diamond 514 to be within the enclosure. Each speaker location is determined by looping from decision diamond 520 back to block 512, and when no further speakers remain to be tested, the logic concludes at block 522 by continuing with any remaining system configuration tasks divulged herein.

Figure 3:
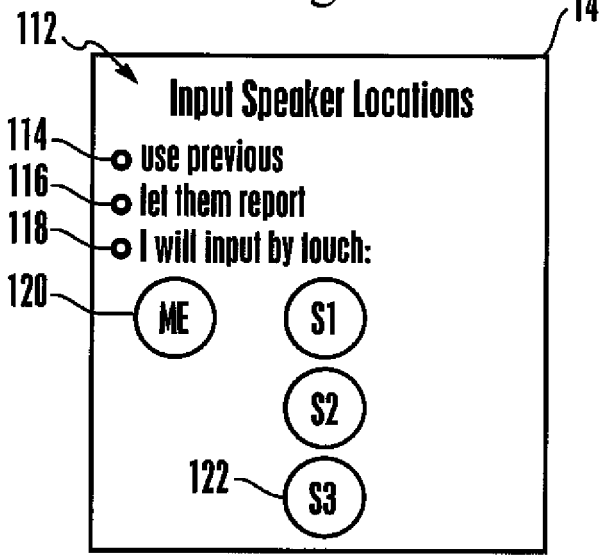
FIGS. 3-6 are example user interfaces (UI) according to present principles.

FIG. 3 shows a UI 112 that may be presented on the display 14 (which preferably is touch-enabled) of the CE device 12 as part of launching the virtual sound stage application. The user can select 114 to use a previous track-to-speaker mapping, e.g., in cases in which the user knows he wants to repeat play of an audio file the tracks of which he has previously mapped to respective speakers 40. Or, the user may select 116 to command the speakers to report their locations as obtained by, e.g., GPS receivers on each speaker. Yet again, the user may select 118 to input the locations by touch, touching a part 120 of the display 14 indicating the listener location and parts 122 indicating speaker locations. The user may also indicate the names and/or speaker IDs of the locations 122 so that the application knows what speaker with what characteristics is located where, relative to the other speakers and to the listener location.

Figure 4:
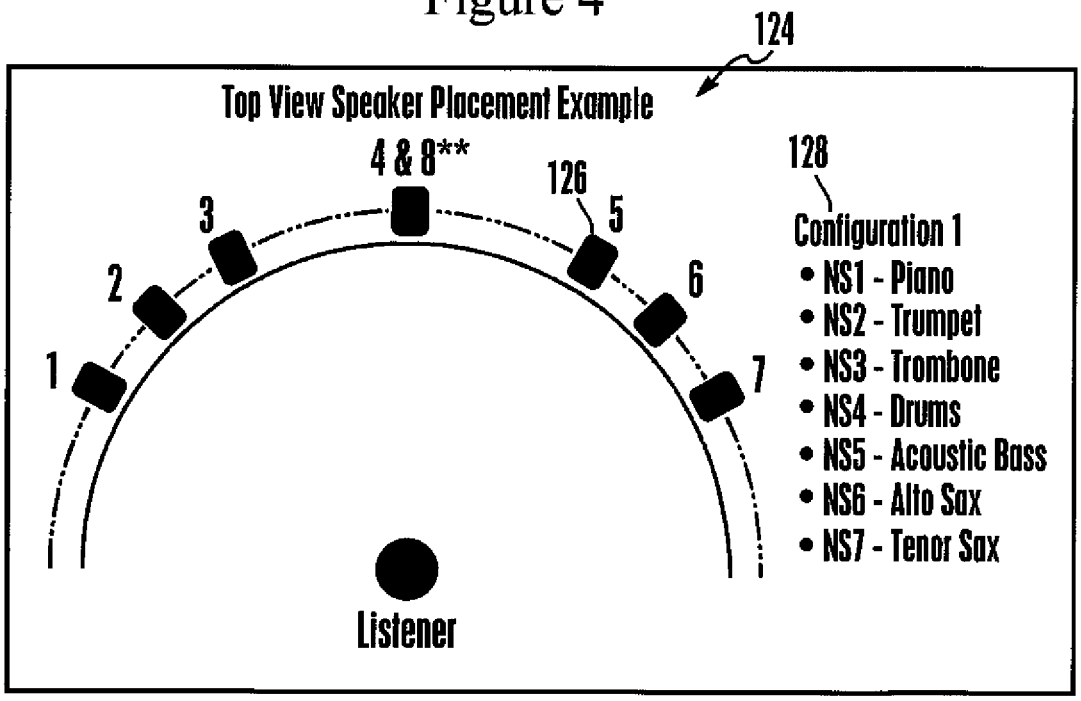
Figure 5:
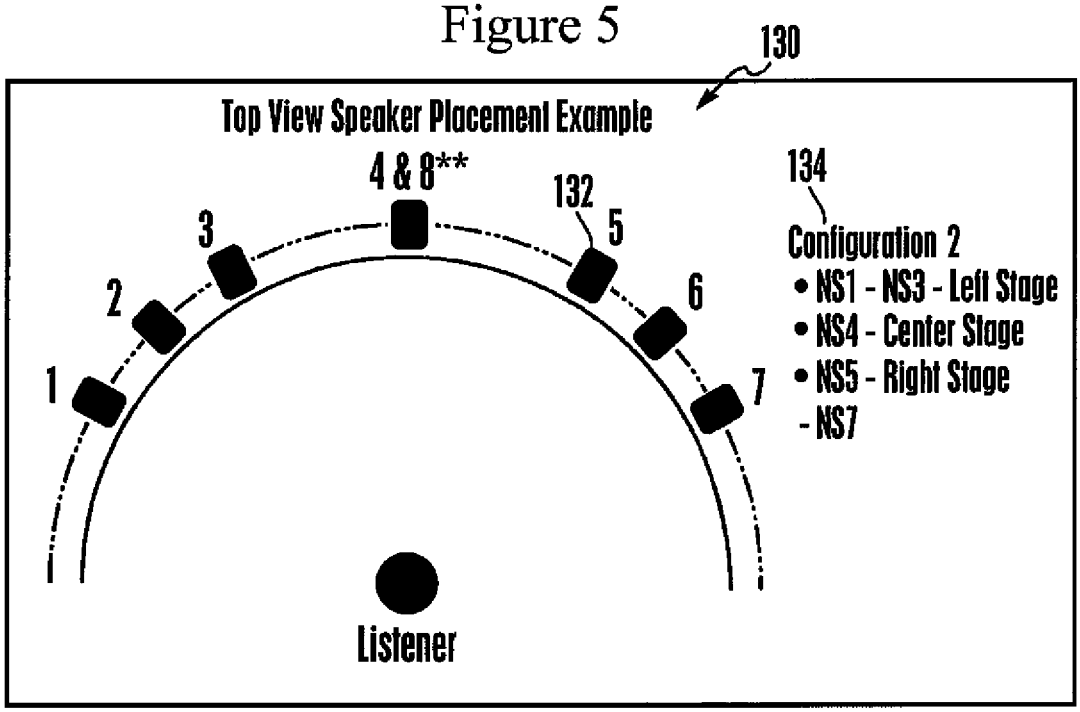
Figure 6:
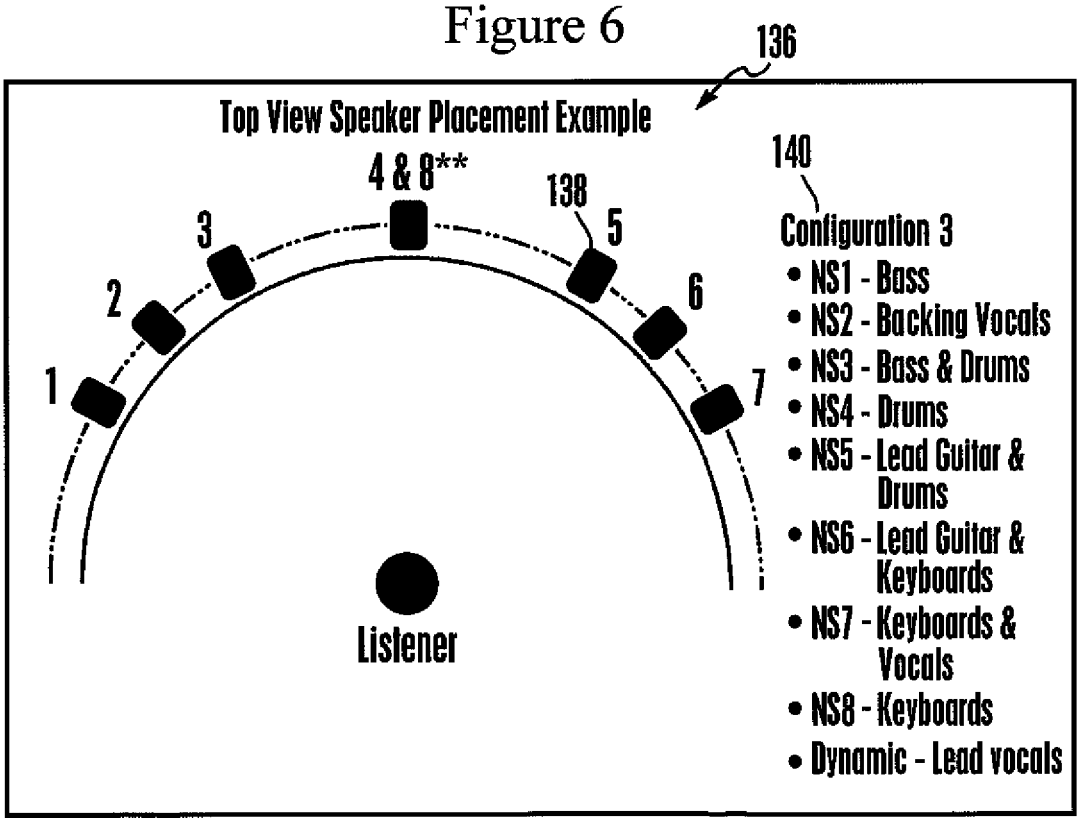

The user may then select to invoke a mapping UI such as any of the non-limiting example UIs shown in FIGS. 4-6. The UI 124 of FIG. 4 shows an eight speaker arrangement 126 with speaker numbers according to speaker location information obtained at block 96, in this example indicating that speakers 4 and 8 have been combined by stacking them one on top of the other or side by side, as the speaker location information obtained at block 96 may indicate. A list 128 of tracks is presented as obtained from the metadata gathered at block 98 for the audio file designated for play. The tracks listed in the list 128 are individual instrument tracks. Individual voice tracks might be provided in addition or in lieu of instrument tracks in other audio files. A user can drag and drop an entry in the list 128 onto the desired speaker 126 to correlate the dragged entry with the dropped-on speaker, and can do this for every track in the list 128 until all seven tracks have been associated with the respective seven speaker locations (owing to speakers 4 and 8 being co-located). Note that a default track-to-speaker mapping may be initially established by the application. One default rule may be to assign tracks in order down the list 128 to respective speakers in order left to right in front of the listener location. Another default rule may be to assign tracks that can be inferred to involve low (bass) frequencies from, e.g., their name (for instance, a track whose metadata indicates "acoustic base" may be inferred to involve low frequencies) to the center-most speaker, or to any combined speaker (in this case, 4 and 8), or to a speaker located closest to a corner of the enclosure 70, with other tracks being mapped to speakers at random. The example default rules are not intended to be limiting.

The UI 130 of FIG. 5 shows an eight speaker arrangement 132 with speaker numbers according to speaker location information obtained at block 96, in this example indicating that speakers 4 and 8 have been combined by stacking them one on top of the other or side by side, as the speaker location information obtained at block 96 may indicate. A list 134 of tracks is presented as obtained from the metadata gathered at block 98 for the audio file designated for play. The list 134 indicates stage locations corresponding to the tracks, in this case, left stage, center stage, and right stage. A user can drag and drop an entry in the list 134 onto the desired speaker 132 to correlate the dragged entry with the dropped-on speaker, and can do this for every track in the list 134 until all three tracks have been associated with the respective three speaker combinations. Note that a default track-to-speaker mapping may be initially established by the application. One default rule may be to assign tracks in order down the list 134 to respective speakers in order left to right in front of the listener location. The example default rules are not intended to be limiting.

The UI 136 of FIG. 6 shows an eight speaker arrangement 138 with speaker numbers according to speaker location information obtained at block 96, in this example indicating that speakers 4 and 8 have been combined by stacking them one on top of the other or side by side, as the speaker location information obtained at block 96 may indicate. A list 140 of tracks is presented as obtained from the metadata gathered at block 98 for the audio file designated for play. The example list 140 of FIG. 6 indicates tracks corresponding to individual instruments, individual vocal parts, and combinations thereof as shown. A user can drag and drop an entry in the list 140 onto the desired speaker 138 to correlate the dragged entry with the dropped-on speaker, and can do this for every track in the list 138 until all seven tracks have been associated with the respective seven speaker locations (owing to speakers 4 and 8 being co-located). Note that a default track-to-speaker mapping may be initially established by the application. One default rule may be to assign tracks in order down the list 140 to respective speakers in order left to right in front of the listener location. Another default rule may be to assign tracks that can be inferred to involve low (bass) frequencies from, e.g., their name (for instance, a track whose metadata indicates "bass & drums" may be inferred to involve low frequencies) to the center-most speaker, or to any combined speaker (in this case, 4 and 8), or to a speaker located closest to a corner of the enclosure 70, with other tracks being mapped to speakers at random. The example default rules are not intended to be limiting.

Note that when more speakers exist than tracks, the user may designate multiple speakers to play the same track. Similarly, when more tracks exist than speakers, the user may designate one speaker to play multiple tracks.

While the particular AUDIO SPEAKER SYSTEM WITH VIRTUAL MUSIC PERFORMANCE is herein shown and described in detail, it is to be understood that the subject matter which is encompassed by the present invention is limited only by the claims.

What is claimed is:

1. A device comprising:

at least one computer memory that is not a transitory signal and that comprises instructions executable by at least one processor for:

receiving plural audio speaker network addresses and speaker characteristics, each associated with a respective speaker;

receiving information regarding plural tracks of an audio recording, the information indicating for each track one or more of: individual instruments, individual voice types, individual voice roles, individual instrument types, modeled stage position of a source of audio for the respective track; and using speaker network addresses, assigning tracks to respective speakers, wherein the information regarding plural tracks of an audio recording indicates, for at least plural tracks, respective modeled stage positions of respective sources of audio for the respective tracks, and the respective tracks are assigned to respective speakers based on the modeled stage positions of the respective sources of audio and the speaker characteristics, wherein at least one track is associated with a respective speaker combination comprising plural speakers.

2. The device of claim 1, wherein the instructions are executable for mapping tracks to respective speakers based at least in part on user input.

3. The device of claim 1, wherein the information regarding plural tracks of an audio recording is received from a storage medium bearing the audio recording.

4. The device of claim 1, wherein the information regarding plural tracks of an audio recording is received from a network server separate from a storage medium bearing the audio recording.

5. The device of claim 1, wherein the information regarding plural tracks of an audio recording indicates, for at least one track, an individual instrument.

6. The device of claim 1, wherein the information regarding plural tracks of an audio recording indicates, for at least one track, an individual voice type.

7. The device of claim 1, wherein the information regarding plural tracks of an audio recording indicates, for at least one track, an individual voice roles.

8. The device of claim 1, wherein the information regarding plural tracks of an audio recording indicates, for at least one track, an individual instrument type.

9. Method comprising:

receiving first information pertaining to plural tracks of an audio recording;

the information regarding plural tracks of an audio recording indicating, for at least plural tracks, respective modeled stage positions of respective sources of audio for the respective tracks; and assigning by an application and/or by hardware the respective tracks to respective speakers based on the modeled stage positions of the respective sources of audio and speaker characteristics received from a network.

10. The method of claim 9, comprising providing a track to speaker mapping application to a consumer electronics (CE) device usable by a person to execute a user input.

11. The method of claim 10, determining whether speaker characteristics have been obtained and responsive to a determination that the characteristics have not been obtained, communicating with the speakers via individual speaker identifications (IDs) to obtain the characteristics.

12. The method of claim 9, wherein the information regarding plural tracks includes, for at least some tracks, for each track one or more of: individual instruments, individual voice types, individual voice roles, individual instrument types, modeled stage position of a source of audio for the respective track.

* * * * *